United States Patent [19]

Day

[11] 4,053,056

[45] Oct. 11, 1977

[54] CIGARETTE PACKAGE INSPECTION APPARATUS

[75] Inventor: John Herbert Day, Midlothian, Va.

[73] Assignee: AMF Incorporated, White Plains, N.Y.

[21] Appl. No.: 706,428

[22] Filed: July 19, 1976

[51] Int. Cl.[2] ..... B07C 5/342

[52] U.S. Cl. ..... 209/73; 209/74 M; 209/111.7 R

[58] Field of Search ..... 209/73, 74, 74 M, 75, 209/111.7 R, 111.5, 111.6; 198/626, 627

[56] References Cited

U.S. PATENT DOCUMENTS

| | | | |
|---|---|---|---|
| 2,922,519 | 1/1960 | Radley | 209/111.7 R |
| 3,203,547 | 8/1965 | Giulie et al. | 209/111.7 |
| 3,289,832 | 12/1966 | Ramsay | 209/75 |
| 3,721,340 | 3/1973 | Kruse | 209/74 R |
| 3,800,941 | 4/1974 | Powell | 209/74 R |
| 3,939,984 | 2/1976 | Butner | 209/74 M |

*Primary Examiner*—Allen N. Knowles
*Attorney, Agent, or Firm*—George W. Price; Charles J. Worth

[57] ABSTRACT

Inspection and conveyor apparatus have a pair of laterally spaced, substantially parallel endless belt conveyors engaging the top and bottom ends of cigarette packs and moving the packs through an inspection station and past a rejection station to a delivery station, electro-optical means programmed to inspect selected portions of the packs passing through the inspection station to detect faults and provide signals synchronized with incremental movement of the packs, the optics and light source of each electro-optical means being off-set within a range of 20° to 70° from a position normal to the surface being inspected, means for receiving signals from the electro-optical means and for providing a reject signal when a fault is detected and release means for laterally moving at least one of the endless belts away from the other when a reject signal is received to release a defective cigarette pack at the reject station.

10 Claims, 6 Drawing Figures

CIGARETTE PACKAGE INSPECTION APPARATUS

This invention relates generally to package inspection and more particularly to automatic electro-optical inspection of cigarette packs and rejection of such packs found to be unacceptable.

A set pack of cigarettes consists of a formed group of cigarettes foil wrapped and, except for the pack top, overwrapped with a printed paper label. The label flaps are sealed to close the bottom of the pack and a stamp is applied across the foil flaps to close the top of the pack. The top of the label should be as close to the fold as possible of the foil flaps at the top of the pack. The pack is then fully wrapped in a sheet of cellophane which is sealed along one side and at the top and bottom ends of the pack and is provided with a tear strip or tape which encircles the pack and is spaced nominally from the top thereof.

The package not only provides an enclosure which protects the cigarettes and maintains the freshness of the tobacco, but is designed for the aesthetic senses of potential purchasers. Therefore, inspection for package integrity and proper relationship of the various parts of the package is required. Because of progressively increasing operating speeds of cigarette making and packaging equipment, visual inspection will no longer suffice and fast sophisticated inspection means are required.

Of primary concern in cigarette package inspection is the presence and proper location of the foil, label and cellophane wrap with the tear strip. It is also desirable to inspect the flaps at the top and bottom of the pack. Some manufacturers provide a premium coupon on the back of the pack, and the absence of the coupons would create customers complaints.

It has been found that the foregoing can be successfully accomplished by electro-optical scanning means, only, however, if the successive packs are precisely positioned while being scanned and are moved at a substantially constant synchronized speed. Another problem attendant with electro-optical scanning cellophane wrapped packages is specular light reflection which tends to obscure the optics of the scanner and provide inaccurate signals.

Accordingly, an object of the present invention is to provide inspection and conveying means for cellowrapped cigarette packs having an inspection station with electro-optical means for scanning selected portions of each pack being moved through the inspection station.

Another object of the present invention is to provide the foregoing inspection and conveying means with optical scanning means and a light source for each of such means so positioned to prevent specular light reflection from obscuring the scanning means.

Still, another object of the present invention is to provide the foregoing inspection and conveying means which will move successive packs through the inspection station at a substantially constant speed, with its incremental movement synchronized with signal generation, to a delivery point.

And, another object of the present invention is to provide the foregoing inspection means which will release a pack at a reject station when found unacceptable at the inspection station.

And, still another object of the present invention is to provide the foregoing inspection and conveying means which positively engage and hold packs moved through the inspection station so successive packs are maintained in the same registration with the scanning means.

The foregoing and other objects and advantages of the invention will appear more fully hereinafter from a consideration of the detailed description which follows, taken together with the accompanying drawings wherein several embodiments of the invention are illustrated by way of example. It is to be expressly understood, however, that the drawings are for illustration purposes only and are not to be construed as defining the limits of the invention.

A cigarette package inspection and conveying unit made in accordance with the present invention is versatile and may be used between primary and secondary storage means, two pieces of operating apparatus, or a combination of the foregoing. Merely to facilitate description, the novel device is shown and will be described as receiving cigarette packs from a cellowrapper CW with end flap sealers S, and delivering acceptable packs to a cartoner C.

Figure 1:
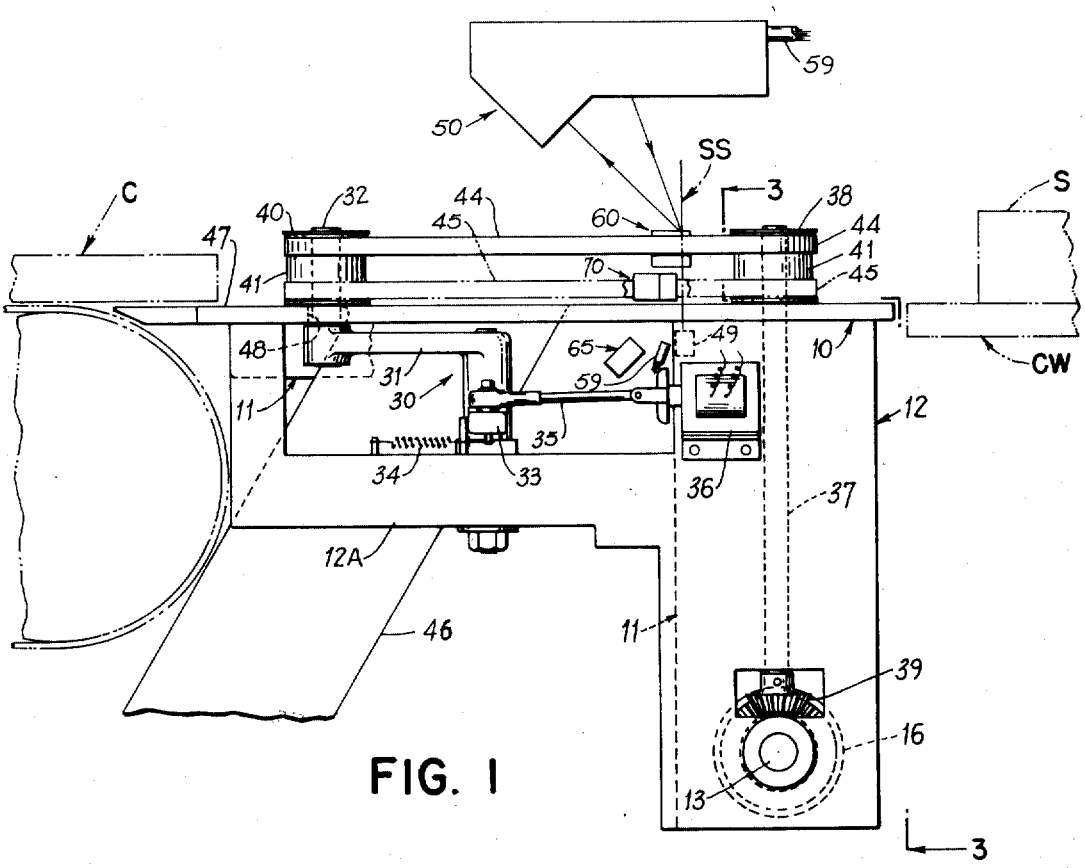
FIG. 1 is a side elevational view of inspection and conveying apparatus made in accordance with the present invention.
Figure 2:
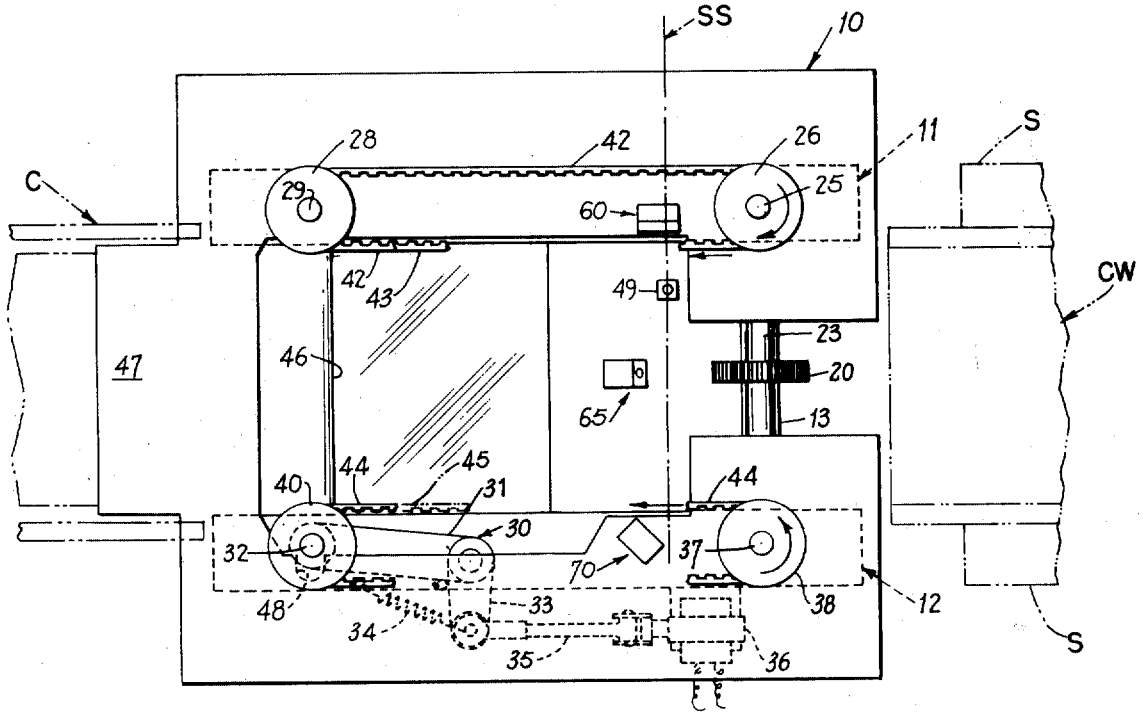
FIG. 2 is a plan view of the apparatus of FIG. 1.
Figure 3:
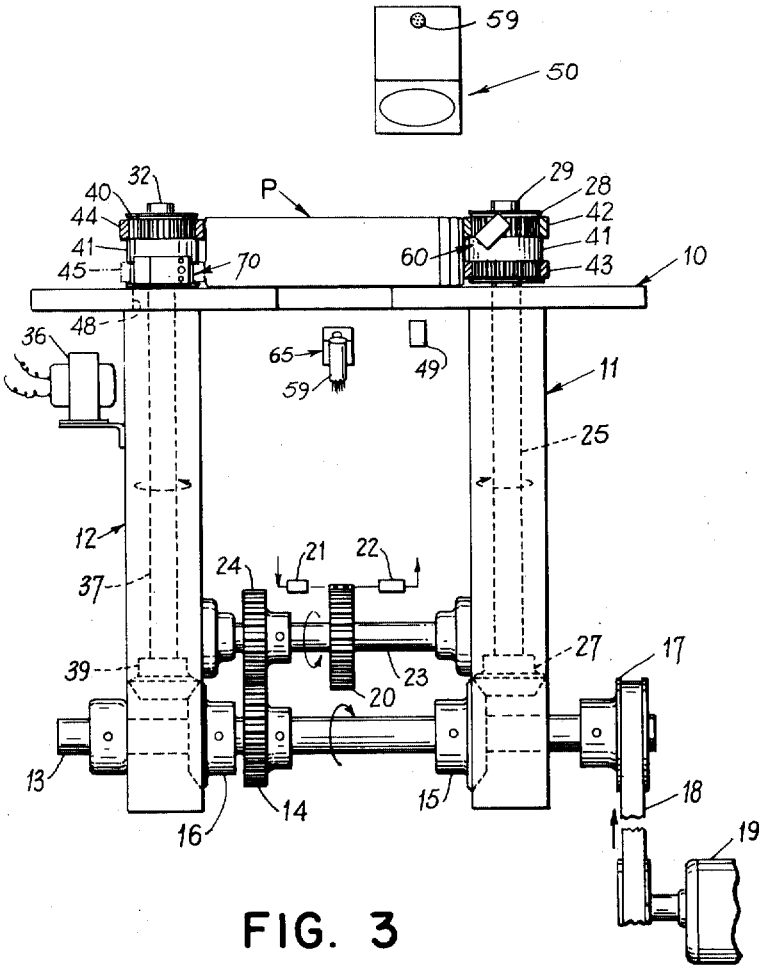
FIG. 3 is an end elevation, with the drive pulley broken away, as viewed on line 3—3 of FIG. 1.

Referring now to the drawings and particularly to FIGS. 1 to 3, a U-shaped bed plate 10 is mounted on a pair of parallel spaced apart frame members 11 and 12; frame member 11 being of inverted L-shape and frame member 12 being of inverted h-shape providing a horizontal portion 12A vertically spaced from the plate 10 for mounting a bell crank 30.

A horizontal power shaft 13 is journaled in the lower portions of the frame members 11 and 12. Mounted on the shaft 13 are a bevel gear 15 adjacent member 11, a bevel gear 16 adjacent member 12, a drive gear 14 between the bevel gears, and a pulley 17 outwardly of the frame member 11 as best shown in FIG. 3. A belt 18 drivingly connects pulley 17 to a motor 19. A shaft 23, also journaled in the frame members 11 and 12, is provided with a pinion 24 in mesh with gear 14. As diagrammatically shown, mounted on the shaft 23 is a slotted disk or cup 20 of an optical encoder having a light source 21, such as an LED, and a light responsive device 22, such as a photodiode, each disposed on the opposite side of the disk or cup 20 from the other. The optical encoder may be any suitable commercially available device such as a model 811 or 991 encoder manufactured by Disc Instruments, Inc.

A vertical shaft 25 is rotatably mounted in the frame member 11 and is provided at its lower end with a bevel gear 27 in mesh with the bevel gear 15 mounted on shaft 13. Similarly, a vertical shaft 37 is rotatably mounted in the frame member 12 and is provided at its lower end with a bevel gear 39 in mesh with the bevel gear 16 mounted on the shaft 13. Both shafts 25 and 37 extend upwardly through the plate 10. A timing belt or splined driving pulley 26 is fixedly mounted on the exposed upper end of the shaft 25 and a similar driving pulley 38 is fixedly mounted on the exposed upper end of the shaft 37. It should be noted that the encoded disk or cup 20 is driven in syncronism with the pulleys 26 and 38 which rotate at the same speed but in directions opposite to one another, as will be further discussed.

A timing belt or splined pulley 28, similar to pulleys 26 and 38, is rotatable as an idler on a shaft 29 mounted on the plate 10 and longitudinally spaced from the shaft 25. The bell-crank 30 which is mounted on the horizontal portion 12A of the frame member 12 has a driven arm 31 and a driving arm 33. The free end of the driven arm 31 is provided with a stub shaft 32 which extends upwardly through a slot 48 in the plate 10 and mounts, as an idler, a timing belt or splined pulley 40 similar to the pulleys 26, 28 and 38.

A spring 34, connected at its ends to the frame member 12 and the free end of the arm 33, biases the bell-crank 30 to its normal operating position where the shaft 32 is spaced laterally from the shaft 29 a distance equal to the lateral distance between shafts 25 and 37, and longitudinally from the shaft 37 a distance equal to the longitudinal distance between the shafts 25 and 29. A solenoid 36 also is connected to the free end of the arm 33 by a rod 35 and, when energized by a reject signal, rotates the bell-crank 30 against the bias of spring 34 to its release position where the shaft 32 and its pulley 40 are moved laterally away from the shaft 29 and its pulley 28.

Upper and lower timing belts 42 and 43 are mounted on the pulleys 26 and 28, and similar upper and lower timing belts 44 and 45 are mounted on the pulleys 38 and 40. Each of the pulleys 26, 28, 38 and 40 is provided with a collar 41 which keeps the upper belts 42 and 44 spaced from the lower belts 43 and 45, respectively.

An inspection or scanning station or plane is nominally indicated by a line SS immediately past (downstream) of the pulleys 26 and 38, and a chute 46 is provided immediately before (upstream) of the pulleys 28 and 40 and forms a reject receiver or station. Since the shafts 25 and 37 with their respective pulleys 26 and 38 are laterally spaced the same distance as shafts 29 and 32 with their respective pulleys 28 and 40, the inner runs of the upper and lower belts 42 and 43 and upper and lower belts 44 and 45 are normally parallel. Because of the speed and direction of rotation of pulleys 26 and 38 as previously discussed, the inner runs all of the belts 42, 43, 44 and 45 will move at the same speed and in the same direction, as shown by the arrows in FIG. 2. from the cellowrapper CW toward the cartoner C.

The parallel inner runs of the belts are laterally spaced an amount to permit belts 42 and 43 and belts 44 and 45 to firmly engage the top and bottom ends of a cigarette pack P received from the cellowrapper CW and move the cigarette pack at a substantially constant rate past the scanning or inspection station SS and the reject chute 46 to a deliver station 47 for the cartoner C. However, upon a reject signal the solenoid 36 rotates the bell-crank 30 against the bias of the spring 34 moving the shaft 32 and its pulley 40 laterally away from shaft 29 and its pulley 28. The inner runs of belts 44 and 45 heretofore parallel with the inner runs of belts 42 and 43, are now divergent and the cigarette pack P is released and permitted to drop into the reject chute 46.

Figure 4:
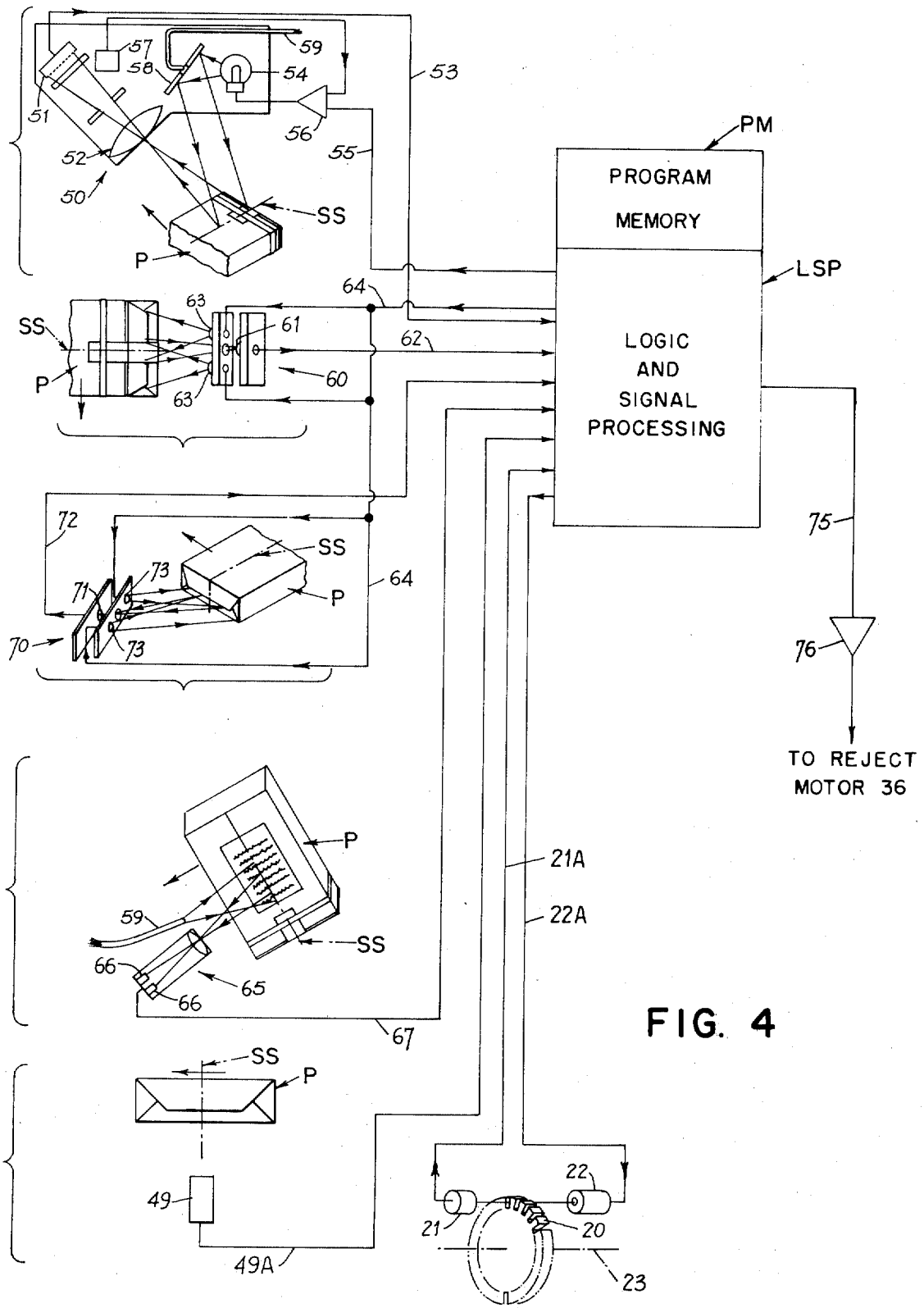
FIG. 4 is a schematic presentation of the electro-optical system of the apparatus of FIG. 1.

The various electro-optical scanning devices are shown in block form in FIGS. 1 to 3 to illustrate their locations relative to the conveying means, and in FIG. 4 to diagrammatically illustrate the structure, field of vision an light source for each such device. A cigarette pack P is shown, at least in part, as a reference with each of the electro-optical scanners to illustrate and facilitate describing the portion of the pack being inspected or scanned. It should be realized that all of the scanners are simultaneously inspecting a pack as it is conveyed through the scanning or inspection station SS.

Since the color and pattern of the label, the color and size of the closure stamp, the color, size and location of the tear strip and the inclusion of a premium coupon vary from one brand of cigarettes to another, the photodiodes, program memory, logic and signal processing must be matched to the specific inspection functions being used and the specific pack being inspected. This can be accomplished by use of selected commercially available integrated circuits or microprocessors such as the model 6800 manufactured by Motorola, Inc., or the model 8080 manufactured by the Intel Corporation. Thus, the specific circuitry forms no part of the present invention except that it performs the required functions as will be discussed.

The spectral light reflectivity of the cellophane wrap of a cigarette pack has been a deterrant to electro-optical inspection. It should be noted that when the light source and optics are normal to the reflective cellophane surface, spectral reflection tends to obscure the optics. Because of the spread or fan-out of the direct and reflected light, angularly off-setting only the optics or only the light source provides no solution until the angle of offset becomes extreme which again creates additional problems. The fact that the cellophane wrap often is not perfectly flat creates random light reflections resulting in further inaccuracies.

It has been found that the useful offset range of the optics and light source is from approximately 20° to 70° from normal to the surface being inspected with the optimum being at approximately 45°, plus or minus 5°. It is preferable to position the optics at optimum with the light source as close as possible to the optics. As the light source is moved away from a position normal to the surface being inspected, the light intensity must be increased to provide corresponding illumination at the surface. Therefore, the light source should be located between such a normal position and the location, of the optics.

It should be understood that while all of the scanning devices are shown and described, all of them do not have to be used except where a maximum number of scanning functions are required. Further, a defect is meant to be misalignment, torn parts, missing parts, foldover, etc. When discussing offset of the optics and light sources, the direction of offset will be relative to the path of flow of the cigarette packs.

The primary scanning means is the line scanner 50 having a light source 54 which utilizes a mirror 58 to project light rays to the upper portion of a pack P, multi-bit photo-diode array 51 which is provided with a controlled apertured lens system 52. The line scanner 50 is disposed above the path of the packs P and is offset toward the conveyor belts 42/43 and inspects only a preselected upper portion of the front of a pack passing through the inspection station SS.

A photodiode 49 is below the path of the packs P in the plane of the inspection station SS and is laterally aligned with the line scanner means. The photodiode 49 receives light from the source 52 which is blocked off as a pack P enters the inspection station SS. At that time, photodiode 49 provides through line 49A an inspection initiate signal to the logic and signal processing means LSP.

A coupon detector 65, when used, is also disposed below the path of the packs P and derives light from the source 54 through a fiber-optic line 59.

A foil detector 60, when used, is disposed between the inner and outer runs of belts 42/43, and is provided with a pair of L.E.D.'s 63 as a light source and has a single photodiode 61 for scanning connected to the logic and signal processing means LSP by a line 62.

A bottom flap detector 70, when used, is disposed between the inner and outer runs of belt 44 and belt 45 is removed. The detector 70 is provided with a single photodiode 71 connected to the logic and processing means LPS by a line 72 and is disposed between a pair of L.E.D.'s 73 forming a light source. All of the L.E.D.'s 63 and 73 are connected by a line 64 to the logic and signal processing means LPS.

The light source 21 of the encoder is connected to the logic and signal processing means LPS while the light responsive element 22 alternately sees and is blocked from its light source by the rotating disk 20, and provides signal pass pulses, corresponding to incremental movement of a pack P through the inspection station SS, through its line 22A to the logic and signal processing means LPS. The signal pass pulses pulse the L.E.D.'s 63 and 73 and, therefore, the photo-diodes 61 and 71 each will provide a signal to the logic and signal processing means LPS for each incremental amount of movement of a pack P through the inspection station.

Accordingly, the memory PM of the logic and signal processing means is programmed along a single X axis corresponding to longitudinal path of the packs being inspected. The memory also can be programmed to provide one or more windows and inspection does not have to continue across the full width of the pack unless it is considered to be desirable.

The signal pulses from the encoder control the signals from the photodiodes 66 of the coupon detector 65 and the photodiode array 51 of the primary detector or line scanner 50. Thus the memory for these detectors also are programmed along the X axis. However, the photodiode array scans laterally down from the top of the pack P as shown in FIG. 4 and the memory for the line scanner 50 must also be programmed along a Y axis. Again, programming along the X axis can establish windows and scanning along the full width of the pack is not necessary unless desired. It should be readily seen that, depending upon the label pattern, the line scanner 50 can detect missing, torn or misaligned tear tapes, cellophane wraps, labels and closure stamps. Crushed packs will cause misalignment of the label and, therefore, the line scanner 50 will detect this too. The foil detector 60 scans along the center of the pack top and detects missing, torn, misaligned and improperly folded foil flaps including flap foldover. The coupon detector 65 is primarily a presence detector to determine if a coupon is missing. However, with two photodiodes 66 and appropriate programming coupon location can, within limits, also be determined. The bottom detector 70 scans the bottom of the pack between the flap edge and the back of the pack and detects improperly folded flaps and flap fold-over. It will also detect missing and misaligned labels, and labels which are torn at the lower ends thereof.

Figure 5:
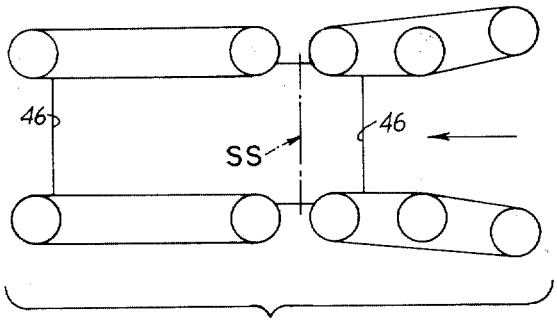
FIGS. 5 and 6 are diagrammatic illustrations of modified conveyors.
Figure 6:
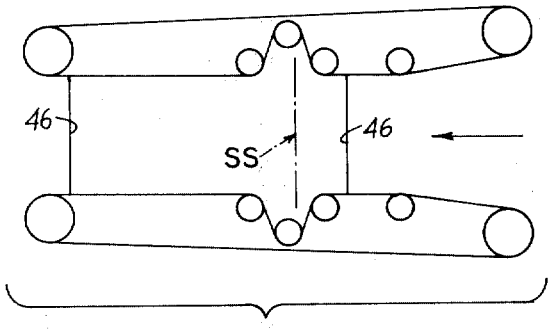

FIGS. 5 and 6 illustrate modified forms of conveyors. In place of the one set of laterally spaced pair of belts 42/43 and 44/45 of FIGS. 1 to 3, two such pairs of belts are diagrammatically shown in FIG. 5. The pair of belts on the infeed side of the path of cigarette packs are flared to provide a tapered entrance. One or both of the second pair of belts can be moved laterally to release reject defective packs, and with separate feed-in belts both the drive and idler pulley can be moved laterally to obtain more efficient release. The first and second pairs of belts are longitudinally spaced to provide mounting space for the electro-optical scanners thus obviating possible belt interference.

FIG. 6 diagrammatically illustrates a further modification of the belt conveyors in which a single pair of laterally spaced belts are provided corresponding to the belts 42/43 and 44/45 of FIGS. 1 to 3 and retaining the characteristics of the belts of FIG. 5. These belts also have a tapered entrance with pockets in the inner runs of the belts corresponding to the space between pairs of belts of FIG. 5. These pockets provide mounting areas for the electro-optical scanners and isolates the infeed drive of the belts on cigarette packs being conveyed through the inspection zone SS from any lateral release movement of the belts to drop rejected packs.

Although several embodiments of the invention have been illustrated and described in detail, it is to be expressly understood that the invention is not limited thereto. Various changes may be made in the design and arrangement of the parts without departing from the spirit and scope of the invention as the same will now be understood by those skilled in the art.

What is claimed is:

1. Cigarette pack inspection and conveying apparatus comprising endless belt conveyor means having pack receiving and delivering ends;

an inspection station and a rejection station disposed in series between said receiving and delivering ends;

said conveyor means engaging the top and bottom ends of cigarette packs and conveying such packs from said receiving end through said inspection station and past said rejection station to said delivering end;

electro-optical scanning means synchronized with incremental pack movement selectively scanning at least a portion of each pack conveyed through said inspection station and providing signals representing detected pack condition;

logic and signal processing means with a programmable memory connected to said scanning means for receiving therefrom and providing a reject signal when the signals from said scanning means represent a defective package condition; and reject means connected to said logic and signal processing means for receiving reject signals, and to said conveyor means and causing said conveyor means to release a detected defective pack at said rejection station when a reject signal is received.

2. The apparatus in accordance with claim 1, and scanning means including:

light responsive means for detecting packs as they are conveyed into said inspection station and for providing an enabling pulse to said logic and signal processing means each time a pack is detected, and photo-electric encoder means driven in synchronism with said conveyor means and providing signal pass pulses to said logic and signal processing means representing incremental cigarette pack movement.

3. The apparatus in accordance with claim 2, and said conveyor means comprising:

at least one pair of driven endless belts laterally spaced from each other, and each belt having an inner run substantially parallel to the inner run of the other.

4. The apparatus in accordance with claim 3, and the inner runs of the belts defining a path for cigarette packs being conveyed;

the receiving end of each inner run being flared away from the other forming a tapered entrance and being formed to provide a pocket spaced from the ends of said belts and in laterally spaced face to face alignment with the pocket formed in the inner run of the other of said belts; and said inspection station having a nominal plane extending transversely across the defined path for the cigarette packs and into the formed pockets.

5. The apparatus in accordance with claim 3, and said conveyor means comprising:

two pairs of laterally spaced end conveyor belts, each of said pairs being longitudinally spaced from one another;

the inner runs of each pair of belts being substantially parallel to one another defining a path for cigarette packs, and the ends of the inner runs of one of said pairs of belts being flaired to form a tapered entrance at the receiving end of said conveyor means; and said inspection station having a nominal plane extending transversely across for the cigarette packs and into the spaces between the longitudinally space pairs of conveyor belts.

6. The apparatus in accordance with claim 3, and said scanning means further including a line scanner having electro-optical means inspecting a preselected top portion of the front of pack passing through said inspection station for detecting missing and defective labels, tear strips, cellophane and closure stamps;

said line scanner including a light source for said electro-optical means and said light responsive means; and said electro-optical means and said light source being offset in a range from 20° to 70° from a position normal to the surface of packs being inspected.

7. The apparatus in accordance with claim 6, and said scanning means further including:

a foil detector having a light responsive means inspecting the top of a pack at a point midway between the pack front and back as the pack passes through said inspection station to detect missing and defective foil flaps and closure stamps;

said foil detector including a light source for said light responsive means of said foil detector; and said light responsive means and light source of said foil detector being offset in the range of 20° to 70° from a position normal to the surface of the packs being inspected.

8. The apparatus in accordance with claim 7, and said scanning means further including:

a coupon detector having light responsive means inspecting pack backs to detect missing and misaligned premium coupons, and a fiber-optic means having one end at said line scanner to receive light from said source thereof and another end adjacent said coupon detector providing a light source therefor, and said light responsive means of said coupon detector and said other end of said fiber-optic means being offset in a range of 20° to 70° from a position normal to the surface of packs being inspected.

9. The apparatus in accordance with claim 7, and said scanning means further including:

bottom detector means having a light responsive means inspecting the bottom end of a pack at a point between the exposed flap edge and the pack back as the pack passes through said inspection station to detect missing and defective flaps and labels;

said bottom detector including a light source for said light responsive means of said bottom detector; and said light responsive means and light source of said bottom detector being offset in the range of 20° to 70° from a position normal to the surface of the packs being inspected.

10. The apparatus in accordance with claim 9 and said scanning means further including:

a coupon detector having light responsive means inspecting pack backs to detect missing and misaligned premium coupons, and a fiber-optic means having one end at said line scanner to receive light from said source thereof and another end adjacent said coupon detector providing a light source therefor, and said light responsive means of said coupon detector and said other end of said fiber-optic means being offset in a range of 20° to 70° from a position normal to the surface of packs being inspected.

* * * * *